US007168198B2

(12) United States Patent
Newkirk et al.

(10) Patent No.: US 7,168,198 B2
(45) Date of Patent: Jan. 30, 2007

(54) GUN WITH USER NOTIFICATION

(76) Inventors: Reginald Hill Newkirk, 11603 Hartsook St., Valley Village, CA (US) 91601; Toy M. Newkirk, 11603 Hartsook St., Valley Village, CA (US) 91601; Tony N. Newkirk, 11603 Hartsook St., Valley Village, CA (US) 91601

( * ) Notice: Subject to any disclaimer, the term of this patent is extended or adjusted under 35 U.S.C. 154(b) by 0 days.

(21) Appl. No.: 10/871,283

(22) Filed: Jun. 18, 2004

(65) Prior Publication Data

US 2005/0066567 A1 Mar. 31, 2005

(51) Int. Cl.
*F41A 17/06* (2006.01)
*F41A 17/00* (2006.01)

(52) U.S. Cl. ..... 42/70.11; 42/70.01; 89/27.12

(58) Field of Classification Search ..... 42/70.11; 89/27.12

See application file for complete search history.

(56) References Cited

U.S. PATENT DOCUMENTS 4,947,151 A * 8/1990 Rosenberger ..... 340/426.33
5,416,826 A * 5/1995 Butler ..... 379/40
5,479,149 A * 12/1995 Pike ..... 340/539.1
6,363,647 B2 * 4/2002 Kaminski ..... 42/70.11
6,385,894 B1 * 5/2002 Podvin ..... 42/146
6,510,642 B2 * 1/2003 Riener ..... 42/70.11
6,533,149 B2 * 3/2003 Vor Keller et al. ..... 224/244
6,735,897 B1 * 5/2004 Schmitter et al. ..... 42/70.01
2002/0032976 A1 * 3/2002 Riener ..... 42/70.11
2002/0178635 A1 * 12/2002 Martin ..... 42/70.11

* cited by examiner

*Primary Examiner*—Michael J. Carone
*Assistant Examiner*—Bret Hayes
(74) *Attorney, Agent, or Firm*—Gottlieb, Rackman & Reisman, P.C.

(57) ABSTRACT

A gun is disclosed having conventional components and a holster. The gun has means for detecting removal of the gun from the holster, means for processing the output of the detection means, and means for authenticating the user of the gun. The gun has means for notifying remote authorities that the gun has been removed from the holster, means for receiving remote commands to lock the trigger and/or initiate a global positioning system. The gun has means for selectively locking the trigger from a remote location and means for selectively activating a global positioning system from the remote location.

5 Claims, 6 Drawing Sheets

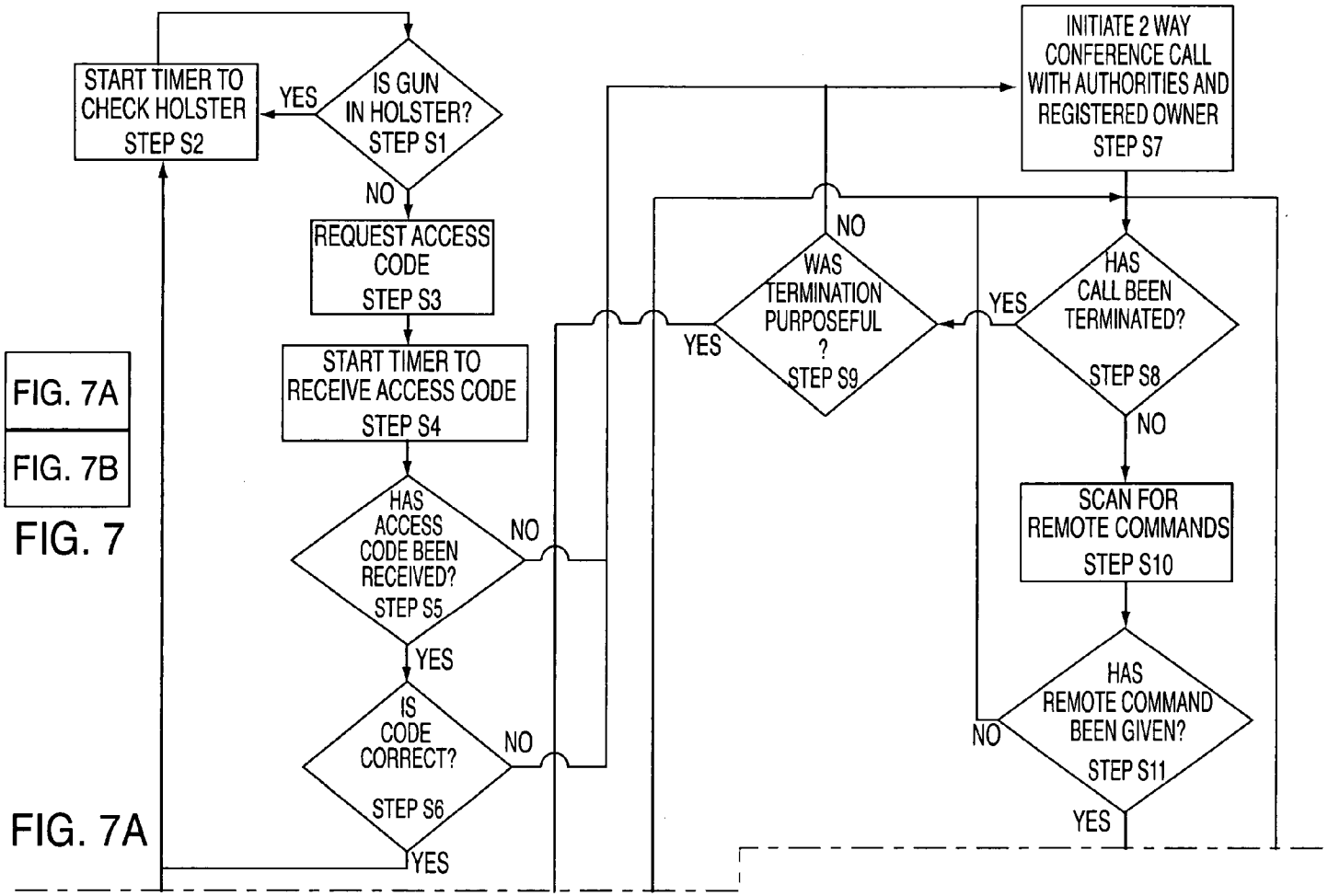
IS GUN IN HOLSTER? STEP S1
YES
NO
START TIMER TO CHECK HOLSTER STEP S2
REQUEST ACCESS CODE STEP S3
START TIMER TO RECEIVE ACCESS CODE STEP S4
HAS ACCESS CODE BEEN RECEIVED? STEP S5
NO
YES
IS CODE CORRECT? STEP S6
NO
YES
INITIATE 2 WAY CONFERENCE CALL WITH AUTHORITIES AND REGISTERED OWNER STEP S7
HAS CALL BEEN TERMINATED? STEP S8
YES
NO
WAS TERMINATION PURPOSEFUL ? STEP S9
NO
YES
SCAN FOR REMOTE COMMANDS STEP S10
HAS REMOTE COMMAND BEEN GIVEN? STEP S11
NO
YES
FIG. 7A
FIG. 7B
FIG. 7
FIG. 7A

GUN WITH USER NOTIFICATION

FIELD

The present application relates to firearms and more specifically to firearms capable of being remotely tracked for security purposes.

BACKGROUND

Guns enhanced for security purposes are known in the art. U.S. Pat. Nos. 6,580,876 and 6,363,223 to Gordon (commonly referred to as "Gordon") disclose a "Photographic Firearm Apparatus and Method" and are incorporated herein by reference. Gordon discloses enhancing a gun with a digital camera. The purpose of the camera is to take pictures of the target. A variety of means are disclosed to activate the camera. Once activated, the camera waits for instruction to take pictures. The gun has an accelerometer and circuitry which instructs the camera to take pictures responsive to the accelerometer detecting impulse movement, such as when the gun is fired.

Regarding the means for activating the camera, Gordon discloses a heat sensor that is capable of sensing the body heat of a user. Gordon also discloses an IR sensor that senses when the gun is near the face of a user. The IR switch could consist of a retina scanner which activates the camera upon detecting a retina. Alternatively, Gordon discloses a manual switch for activating the camera. Another alternative is a pressure sensor or strain gauge potentiometer that detects the pressure from a person's grip. An electronic sensor can be used to detect when the firearm is removed from a holster. An electro-magnetic sensor can be placed in the gun and the holster that senses when the gun is removed from the holster.

U.S. Pat. No. 5,685,636 to German discloses an "Eye Safe Laser Security Device" incorporated herein by reference. German teaches a gun, a camera and a remote console. The camera is mounted to the gun and responsive to a person using the gun, the camera sends images of the target to the remote console. German also teaches a power source and a laser diode mounted on the gun. The laser diode illuminates following a firing of the gun.

U.S. Pat. No. 5,479,149 to Pike teaches a "Weapon Use Monitoring and Recording System" and is incorporated herein by reference. Pike discloses a gun for a police officer, where the gun has an audio sensor and a location sensor. In response to the gun being removed from the holster, the sensors record information. The recorded information is transmitted to the police station which can then provide required assistance.

U.S. Pat. No. 4,989,024 to Myers and U.S. Pat. No. 4,835,621 to Black both teach guns capable of recording images of targets through the gun barrel in lieu of shooting projectiles.

U.S. Pat. No. 5,491,464 to Carter et al. discloses a "Remotely Controlled Radar Gun and Video Recording Apparatus." Carter teaches placing video cameras in and around a police car capable of recording outside, front seat and backseat activity. A plurality of actuators is used to activate each camera without having to actually engage each camera. Remotely located screens are capable of displaying images recorded by the cameras.

The above patents, separately or in the aggregate, fail to consider two-way communication between the gun and for example, law enforcement agencies, to confirm that the user of the gun is the registered owner of the gun. The patents also fail to consider a trigger that is capable of being remotely locked. A gun with these features would prevent inappropriate use of guns by thieves, helping to deter crimes in general.

SUMMARY

A gun is disclosed having conventional components and a holster. The gun has means for detecting removal of the gun from the holster, means for processing the output of the detection means, and means for authenticating the user of the gun. The gun has means for notifying remote authorities that the gun has been removed from the holster, means for receiving remote commands to lock the trigger and/or initiate a global positioning system. The gun has means for selectively locking the trigger from a remote location and means for selectively activating a global positioning system from the remote location.

BRIEF DESCRIPTION OF THE FIGURES

In order that the manner in which the above recited objectives are realized, a particular description of the invention will be rendered by reference to specific embodiments thereof that are illustrated in the appended drawings. Understanding that the drawings depict only typical embodiments of the invention and are not therefore, to be considered to be limiting of its scope, the invention will be described and explained with additional specificity and detail through the use of the accompanying drawings in which:

FIG. 3 A is a front view of the gun;

DESCRIPTION OF THE EMBODIMENTS

Figure 1:
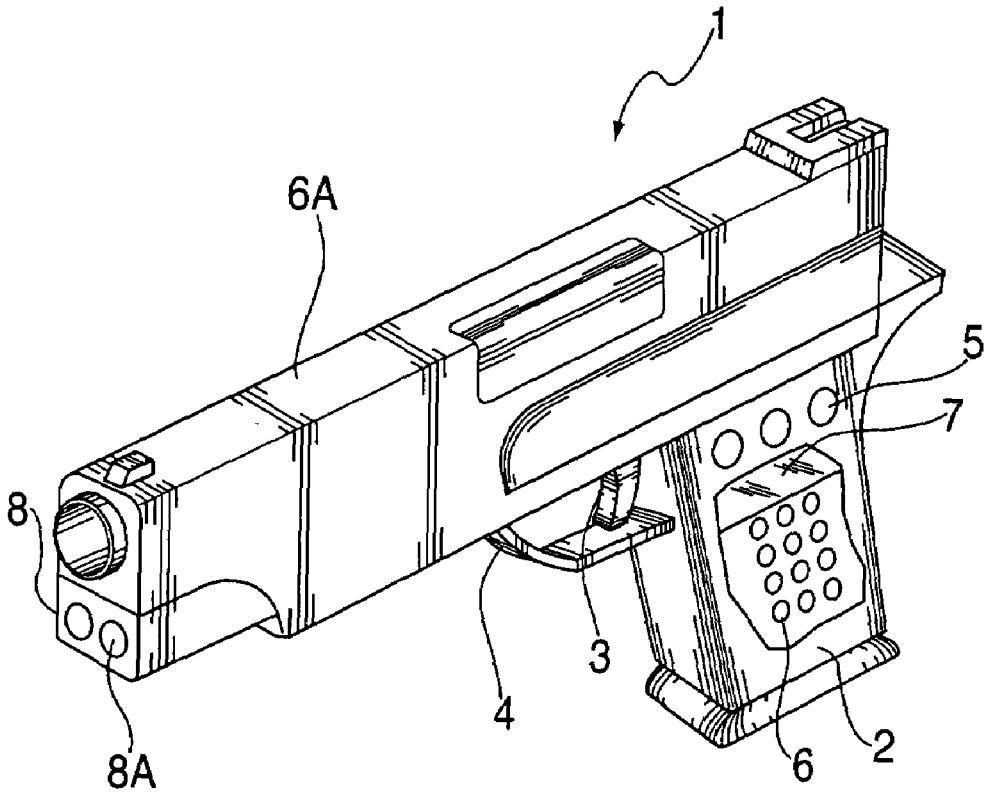
FIG. 1 is a perspective view of the gun.
Figure 2:
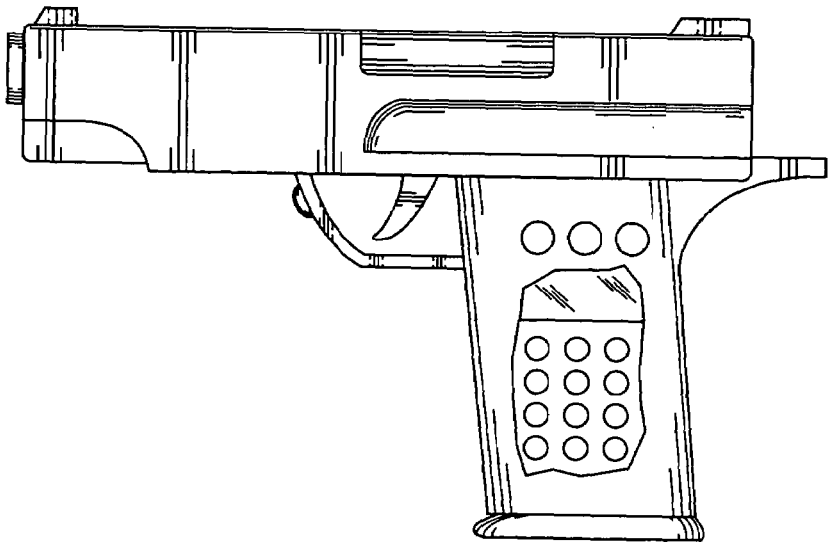
FIG. 2 is a left side view of the gun.
Figure 2A:
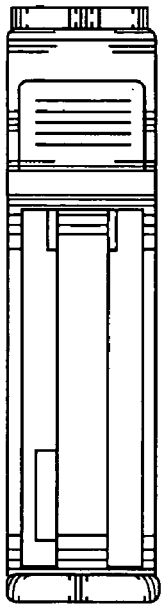
FIG. 2A is a rear view of the gun.

A gun is disclosed that in response to being removed from a holster is capable of notifying authorities of potential use by an unregistered user, the gun capable of being remotely locked by the authorities.

Turning to FIGS. 1, 2, 2A and 3, a pistol is illustrated, it being understood that the invention is equally applicable to other types of guns such as rifle and other assault weapons and firearms. The gun 1 has such typical components as a chamber/grip 2, trigger 3, trigger safety 4, and barrel with Visierung 6 (front and rear sight components). The gun 1 can be manual, semi-automatic, or fully automatic. The chamber 2 is capable of accepting typical cartridges and the barrel is capable of firing typical caliber bullets for the gun type.

A holster (not shown) is used for storing the gun. The holster may be stationary, such as part of a home or office cabinet or gun rack, or on an automobile gun rack. The holster may be portable, such as a belt mountable or automobile mountable holster.

Figure 5:
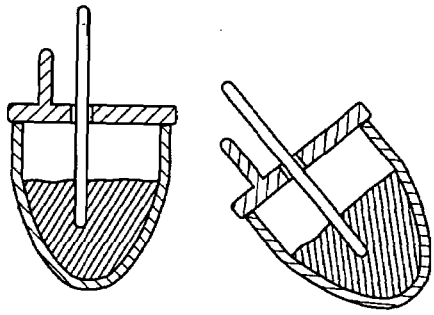
FIG. 5 is a view of a mercury switch capable of indicating if the gun has been removed.

Turning to FIG. 5, means for detecting removal of the gun from the holster are illustrated. The detection means could be a mercury switch integrated into the gun 1. Alternatively, the detection means could be a strain gauge potentiometer attached to a flexible membrane within the holster or grip.

Yet alternatively, the detection means could be an electromagnetic switch. Further, the detection means could be an electromechanical switch that is automatically or manually tripped when inserting the gun into and taking the gun from the holster. Alternatively, the holster may be provided with a gun detecting member.

The detection means is capable of producing an output signal which is indicative of the gun position or location. For example, the output signal consists of two different analog voltage signals, one signal is indicative of the gun being in the holster and one signal is indicative of the gun being out of the holster. The detection means has output ports which are capable of delivering the signals.

Figure 4:
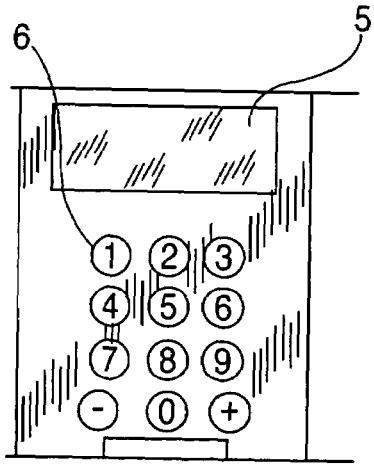
FIG. 4 is a view of a keypad located on the gun.
Figure 6:
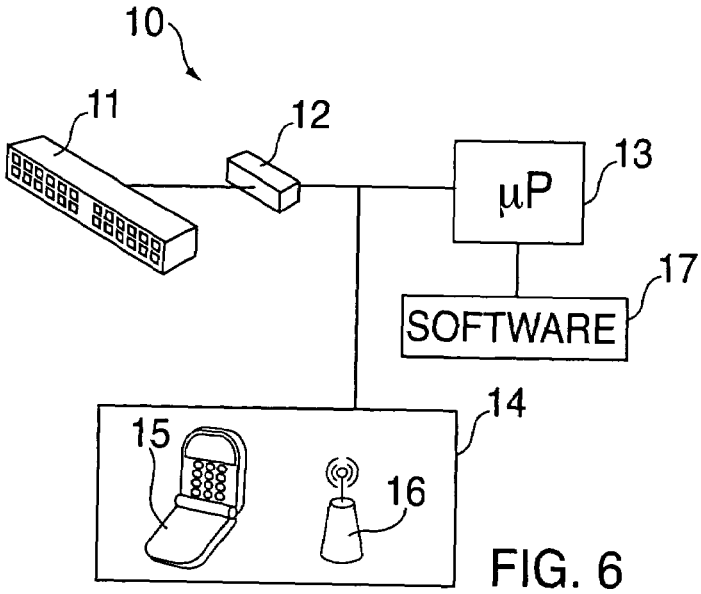
FIG. 6 shows a block diagram for a system for processing detection information.

Turning to FIGS. 4 and 6, the gun has means 10 for processing the output of the detection means. Depending on the signal provided by the detection means, the processing means 10 is capable of determining if the gun is in the holster or if the gun is removed from the holster.

The processing means 10 comprises input ports 11 that are capable of receiving the output from the detection means. To handle the signals, the processing means 10 has standard computer components. For example, the processing means includes a standard analog to digital converter 12, a CPU 13, permanent and temporary memory (not shown) and other standard components for performing the required tasks.

The processing means includes a software operating system such as a Windows or a Palm based operating system. Through the software, the processing means continually checks the output from the detection means. It is to be appreciated that "continually" could mean checking at a frequency of every half a second.

The procession means also includes a screen 5, a keyboard 6 and means 14 for accessing the internet. The internet access means would also be integral with the gun 1. Through these devices, the user is capable of upgrading the software and operating system. The user can also access online services and databases that could provide gun and user specific information. For example, the user might be able to determine how often the user or other person has removed the gun from the holster over a given period of time.

The internet access means is, for example, mobile telephony technology 15, where the user might be required to subscribe to a known carrier for accessing the internet. The internet access means could also comprise input/output connectors 11 on the gun or serial port emulators integral with the CPU. The connectors 11 would include standard connectors such as an RJ-11 phone jack, an RJ-45 Ethernet jack, a USB port.

The serial port emulators for the internet access means could include an IR port or a Bluetooth transceiver 16. If Bluetooth circuitry is used, a second Bluetooth transceiver would need to be located proximal to the gun 1. The second transceiver would provide the gun 1 with internet access using known protocols.

The gun has means 17 for authenticating the user of the gun. The authentication means is activated by the processing means after the processing means determines that the gun has been removed from the holster. The purpose of the authentication means is to determine if the gun user is the registered owner.

The authentication means comprises a software routine that is capable of functioning through the same components used with the processing means. The software causes the gun to request a personal identification number (PIN) from the user. The PIN could be a pre-assigned or pre-selected data unit known to the user before the user has the opportunity to remove the gun from the holster.

Figure 3:
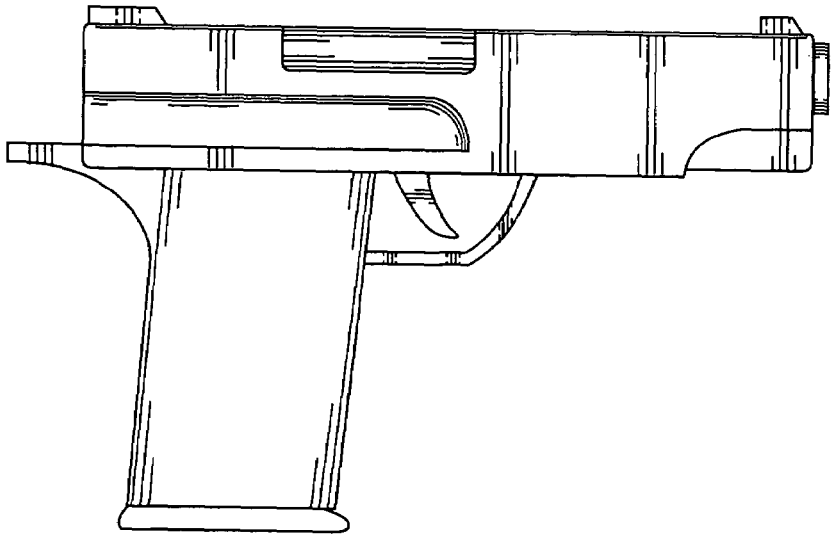
FIG. 3 is a right side view of the gun.
Figure 3A:
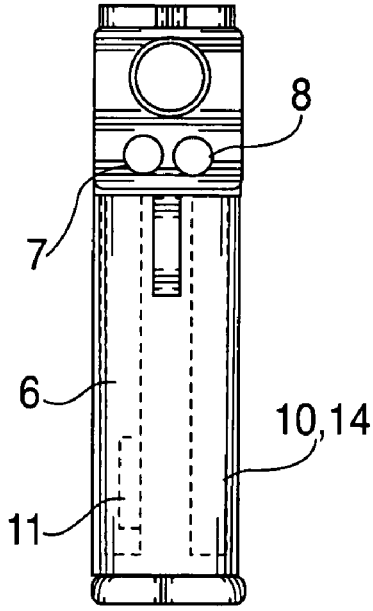

The authentication means is capable of requesting the PIN by stating the request on the screen. Alternatively, the authentication means comprises a speaker 7 (FIG. 3A) for audibly requesting the PIN. The gun is capable of receiving the response to the request through the keyboard 6. Alternatively, the authentication means comprises a microphone 8 capable of receiving the PIN response. The microphone may be a two way microphone integral with the speaker or may be a separate microphone 8.

The authentication means would be programmed to allow the user to enter the PIN over a pre-selected period of time. For example, the user is provided with thirty seconds to enter the PIN. Accordingly, the user has the time to enter the correct number and be appropriately identified.

The authentication means is capable of processing the input from the user, or lack of input from the user. If the user inputs the correct PIN, the authentication means determines that the user is the registered user. At this point, the user is capable of using the gun without regard to the system software. The system software is capable of being automatically reset for monitoring when the gun is placed again in and subsequently, removed from the holster.

The gun has means for notifying remote authorities that the gun has been removed from the holster. The notification means is required for the occasion when the authentication means has determined that user has failed to input the correct PIN or failed to enter any authenticating PIN. Such an occasion would arise when, for example, the gun has been stolen from the holster by a thief.

The notification means is executed through software and comprises hardware provided with the processing means. Through the notification means, appropriate authorities are capable of being contacted for purposes of further attempting to authenticate the user. Through the notification means, the authorities are capable of taking the appropriate action if the user is ultimately, unable to be authenticated.

To contact authorities, the notification means comprises mobile telephony technology 15 along with the speaker 7 and microphone 8 built into the gun. As a backup, the notification means may also comprise voice over IP. Voice over IP would be available if the gun were in a wireless "hotspot" such as LAN access points 16 located throughout many modern cities. Alternatively, voice over IP is accessible using the Bluetooth transceiver along with a proximally located Bluetooth transceiver, where the latter has access to the internet.

Through the disclosed technologies, the notification means is capable of contacting "911" or other pre-selected authority. The notification means is also capable of contacting the registered owner of the gun.

Once the pre-selected party is contacted, the notification means activates the speaker and microphone. The notification means comprises a video monitor 8 for providing a visual image of the situation to the notified parties. Through these elements, the contacted parties, such as the authorities and the registered owner of the gun, are capable of communicating with the user of the gun. Once contacted, the remote parties are capable of determining if the gun is being used by, for example, a thief. Alternatively, the authorities are capable of confirming that the gun is being used by the registered owner and whether the registered owner is in an emergency situation requiring assistance.

While the communication occurs with the pre-selected party, the notification means is capable of continuously monitoring to see if the communication has terminated. If the communication has terminated, the notification means is capable of determining if the termination was purposeful or accidental. Accidental termination would occur, for example, due to a lost signal. If the termination was accidental, then the notification means is capable of reconnecting the call.

The gun has means for receiving remote commands executed by the contacted parties. The remote command may occur because the contacted party determines that an improper party is using the gun. The contacted party would send a signal, which could be an analog or digital signal (i.e. voice or data signal), ordering the locking of the gun trigger. Alternatively, the remote command could be sent to turn on a standard global positioning system (GPS).

The remote command means is executed through software and comprises hardware provided with the processing means. The remote command means comprises a scanner that is capable of scanning for the signals. The scanning rate is substantially continuous at, for example, predetermined intervals of time. The remote command means is capable of operation only during the life of the call initiated by the notification means. The output from the remote command means would be in the form of an output voltage that was created by the a/d converter previously used by the processing means. The signal is capable of being transferred through standard computer cables.

The system has means for locking the trigger which is capable of being activated upon the reception of the output voltage from the remote command means. The trigger lock means comprises, for example, an electromechanical solenoid that locks the trigger hammer or trigger. Alternatively, the trigger lock means comprises an electromagnetic lock for locking the hammer or trigger.

The system has means for resetting the software following the termination of the call and the execution of the remote commands. The reset means is executable though software and is capable of receiving a reset code supplied through the keyboard or microphone. As a result of entering the code, the trigger, if locked, will be released and the global positioning system will become deactivated.

Once the reset means as deactivated the safety precautions, The system will then scan to determine when the gun is replaced into the holster. Until that time, it will be presumed that the gun is being used by the registered owner and no further safety precaution will be taken.

Figure 7B:
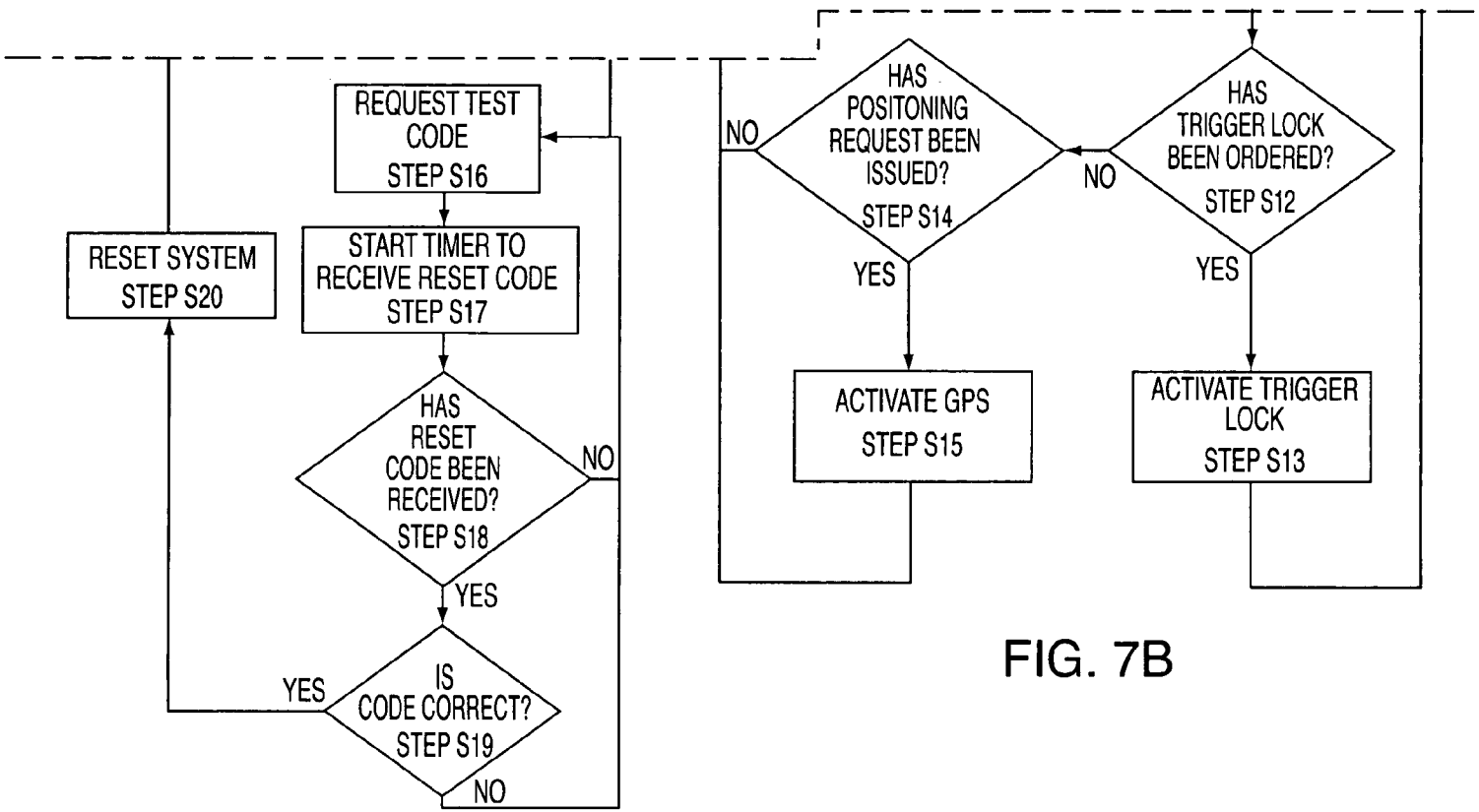
FIG. 7 is a flow chart of a method of using the gun.

Turning now to FIG. 7, the method of operation for the invention is disclosed. Initially, at Step S1, the detection means determines if the gun is in the holster. During this period, the processing means continuously monitors the output voltage from the detection means as illustrated in Step S2.

Upon removal of the gun from the holster, the processing means activates the authentication means at Step S3. There, the system provides the user with the preset period of time to provide the authentication PIN at Step S4. The system is capable of receiving the code in the requisite period of time at Step S5, and the authentication means analyzes the code for correctness at Step S6.

If the received code is correct, then the system will monitor for when the gun is placed back into the holster. Until that time, no further safety precautions will be taken. Once the gun is replaced into the holster, the detection means will begin checking for when the gun is again removed from the holster.

After Step S4, the system might not have received a PIN or the PIN might have been incorrect. In either case, the system proceeds to activate the notification means in Step S7. Here, the system initiates a two way conference call with authorities. The system may also contact the registered owner on a conference call with the authorities.

During the call, the system monitors to see if the call is terminated at Step S8. If the call has been terminated, the system determines if the termination was purposeful at Step S9. If the termination was accidental, due to the lost signal, then the system restarts the call. If the system determines that the termination was purposeful, then the system activates the reset means at Step S16.

During the call, the remote command means monitors for the reception of remote commands from the authorities at Step S10. The monitoring period is for example, a thirty second duration that continues to repeat during the life of the call. If the command is not given in that period of time, the system determines if the call has been terminated and then again scans for a command at Step S11. This loop helps prevent the system from monitoring for commands after the termination of the communication with the authorities.

Upon receiving remote commands, an output signal is received by the trigger lock means and the global positioning system at steps S12 and S14. If the command was intended to activate the trigger lock means, then that means responds accordingly at Step S13. On the other hand, the global positioning system is capable of responding at Step S15 to the activation command.

Following the execution of the remote command, the system again monitors for another remote command. Accordingly, both the GPS and the trigger lock are capable of being activated by remote commands.

Upon the termination of the call, the reset means is activated and the system requests the input of a reset code at Step S16. A timer is set at Step S17 to receive the code. If the code is not received during the preset time period, the system will again ask for the code at Step S18. This loop prevents the gun from being used again until the authorities or registered owner enters the reset code.

Only when the corrected code has been entered, at Step S19, will the system be reset at Step S20. Once reset, the GPS and trigger lock are released. The system will then monitor for the replacement of the gun into the holster and the subsequent removal of the gun from the holster at Step S2.

A gun has been disclosed that, in response to being removed from a holster, is capable of notifying authorities of potential use by an unregistered user, the gun capable of being remotely locked by the notified persons.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

We claim:

1. A method of controlling the use of a gun, the gun having an authorization code input and a holster, the method comprising the steps of:

sensing the removal of the gun from the holster by a user; and receiving an authorization code from the user by means of the code input, wherein said code input includes telephone circuitry that creates a communication link between the user of the gun and a monitoring authority to authorize the user if the user fails to provide a valid authorization code.

2. The method of claim 1 wherein the gun has a global positioning system (GPS) that is activated upon receiving an activation code from the monitoring authority if the user fails to provide the valid authorization code.

3. The method of claim 1 wherein sensing the removal of the gun from the holster by a user is performed automatically.

4. A method of controlling the use of a gun having a holster comprising:

providing a GPS system;

sensing the removal of the gun from the holster by a user;

contacting a monitoring authority to attempt to authorize the user;

receiving a lock code from the monitoring authority for locking the trigger or hammer if the user fails to be authorized; and receiving a code from the monitoring authority for activating said GPS system if the user fails to be authorized.

5. The method of claim 4 wherein sensing the removal of the gun from the holster by a user is performed automatically.

* * * * *